US010000324B2

(12) United States Patent
Ozaki et al.

(10) Patent No.: US 10,000,324 B2
(45) Date of Patent: Jun. 19, 2018

(54) PACKING BAG AND MANUFACTURING METHOD FOR THE SAME

(71) Applicant: MUPACK OZAKI CO., LTD., Yao-shi (JP)

(72) Inventors: Ikuko Ozaki, Yao (JP); Takeo Takashiro, Yao (JP)

(73) Assignee: MUPACK OZAKI CO., LTD., Yao-shi (JP)

( * ) Notice: Subject to any disclaimer, the term of this patent is extended or adjusted under 35 U.S.C. 154(b) by 0 days. days.

(21) Appl. No.: 15/233,095

(22) Filed: Aug. 10, 2016

(65) Prior Publication Data

US 2017/0057722 A1 Mar. 2, 2017

(30) Foreign Application Priority Data

Aug. 25, 2015 (JP) ..... 2015-165634

(51) Int. Cl.

| | |
|---|---|
| ***B65D 33/00*** | (2006.01) |
| ***B65D 75/58*** | (2006.01) |
| ***B65D 75/20*** | (2006.01) |
| ***B31B 19/00*** | (2006.01) |

(52) U.S. Cl.

CPC ..... *B65D 75/585* (2013.01); *B31B 19/00* (2013.01); *B65D 75/20* (2013.01); *B31B 2219/14* (2013.01); *B31B 2219/269* (2013.01); *B31B 2219/6053* (2013.01); *B31B 2219/6061* (2013.01); *B31B 2219/9019* (2013.01); *B31B 2237/10* (2013.01); *B31B 2237/406* (2013.01)

(58) Field of Classification Search

CPC ..... B65D 75/585; B65D 75/20

USPC ..... 383/207–209, 61.2, 5, 203, 204; 229/87.05

See application file for complete search history.

(56) References Cited

U.S. PATENT DOCUMENTS

| | | | | |
|---|---|---|---|---|
| 3,429,432 | A * | 2/1969 | Cabernoch | A61B 50/30 206/223 |
| 4,458,811 | A * | 7/1984 | Wilkinson | A61J 1/2093 206/219 |
| 5,000,321 | A * | 3/1991 | Heilmann | B29C 59/007 229/216 |
| 5,229,180 | A * | 7/1993 | Littmann | B29C 59/007 219/121.68 |
| 6,605,026 | B1 * | 8/2003 | Tomic | B65D 33/2591 493/213 |
| 6,719,678 | B1 * | 4/2004 | Stern | B65D 33/2508 493/212 |
| 7,185,403 | B2 * | 3/2007 | Chaturvedi | B65D 33/2591 24/585.12 |
| 7,334,682 | B2 * | 2/2008 | Goepfert | B65D 75/58 206/494 |

(Continued)

FOREIGN PATENT DOCUMENTS

JP 5715283 B1 5/2015

*Primary Examiner* — Jes F Pascua

(74) *Attorney, Agent, or Firm* — Kratz, Quintos & Hanson, LLP

(57) ABSTRACT

In a packing bag to store a stored article Z with tight seal by a welded sheet material 1, a separation-prepared line portion 5, separable by predetermined tensile force by human hands, is provided, and, the separation-prepared line portion 5 is composed of half-cut laser-worked grooves 7 disposed parallel with a small interval and concaved on an inner face 1*a* and an outer face 1*b*.

3 Claims, 16 Drawing Sheets

(56) References Cited

U.S. PATENT DOCUMENTS

| | | | | |
|---|---|---|---|---|
| 8,247,057 | B2 * | 8/2012 | Velasquez Urey | H05K 13/0084 428/131 |
| 8,408,793 | B2 * | 4/2013 | Martuch | B65D 75/5833 229/87.05 |
| 8,506,165 | B2 * | 8/2013 | Shinozaki | B65D 75/12 229/87.05 |
| 2011/0297681 | A1 * | 12/2011 | Bowers | B65D 75/585 220/266 |

* cited by examiner

PACKING BAG AND MANUFACTURING METHOD FOR THE SAME

BACKGROUND OF THE INVENTION

1. Field of the Invention

This invention relates to a packing bag and manufacturing method for the same.

2. Description of the Related Art

Conventionally, the applicant of the present application has proposed a packing bag formed by welding a sheet material of synthetic resin to tightly seal and preserve stored articles with sanitation (refer to Japanese Patent No. 5715283).

In the packing bag disclosed by Japanese Patent No. 5715283, as shown in FIG. 22, a heated blade 41 contacts an obverse face 40*a* of a sheet material 40 to form a half-cut V-shaped groove 42, and a separation-prepared line portion to be separated is formed with the V-shaped groove 42.

However, in the production process, the sheet material 40 may be oscillated up and down because the V-shaped groove 42 is formed with continuously running the sheet material 40 of belt, and it is difficult to form the V-shaped groove 42 with a constant depth dimension D in a longitudinal direction of the sheet material 40.

As shown in FIG. 23, tensile force F, needed for separation of the separation-prepared line portion, becomes unstable where a depth dimension $D_1$ of the V-shaped groove 42 is too small and the separation can't smoothly conducted. And, as shown in FIG. 24, when a depth dimension $D_2$ becomes excessive, the sheet material 40 may be penetrated, the separation-prepared line is broken on an unintended position and the tight sealing can't be kept.

Therefore, it is an object of the present invention to provide a packing bag with which the separation-prepared line can be smoothly separated with a constant tensile force and the tight sealing is certainly kept.

DESCRIPTION OF THE PREFERRED EMBODIMENTS

Preferred embodiments of the present invention will now be described with reference to the accompanying drawings.

Figure 1:
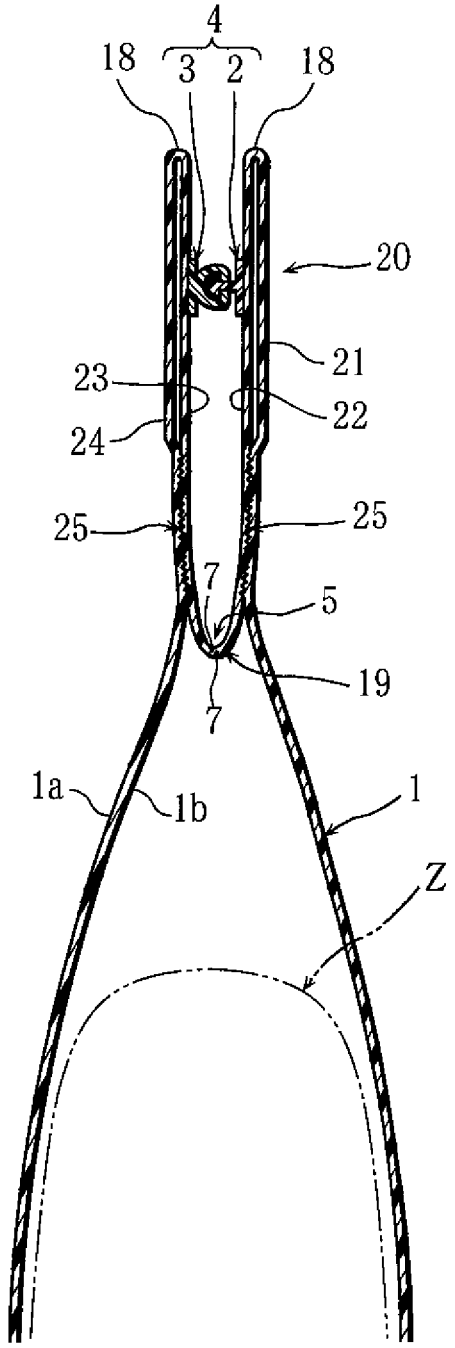
FIG. 1 is a cross-sectional view showing an embodiment of the present invention.
Figure 2:
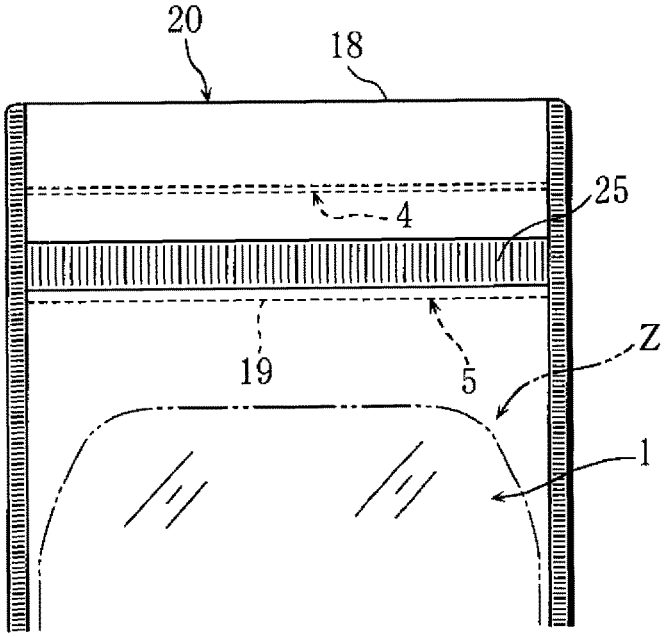
FIG. 2 is a front view showing a packing bag of the present invention.

As shown in FIG. 1 and FIG. 2, in a packing bag of the present invention composed of a rectangular sheet material 1 of synthetic resin, the sheet material 1 is folded on two convex folded line portions 18 and one concave folded line portion 19 to form a folded portion 20, M-shaped in longitudinal cross section and serially having a first sheet layer 21, a second sheet layer 22, a third sheet layer 23, and a fourth sheet layer 24. In the packing bag of the present invention, both of left and right end edge portions are welded to form an opening portion out of figures, a stored article Z is put into the opening portion, and the opening portion is welded to close for storing the stored article Z with tight seal.

Polyolefin resins such as polyethylene and polypropylene are used as the sheet material 1. PET resin or nylon may also be used. The stored article Z is one of articles such as food, medicine, supplement, pet food, cosmetics, or sundries. In the present invention, "welding" is a work in which resins are mutually connected by heat and pressing force without adhesives, and also expressed as "heat press fitting" or "heat welding".

Figure 3:
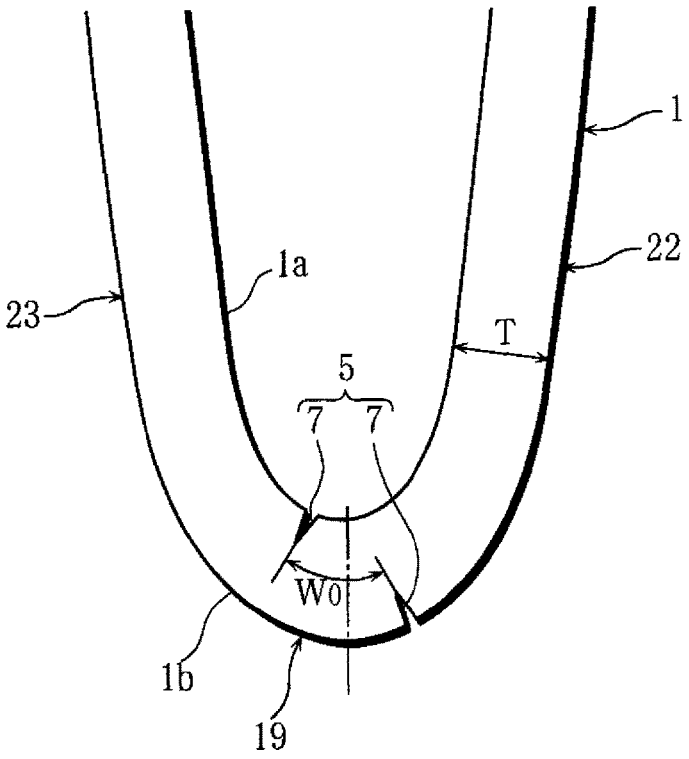
FIG. 3 is an enlarged cross-sectional view of a principal portion.

As shown in FIG. 1 and FIG. 3, the packing bag of the present invention has a separation-prepared line portion 5, with which the second sheet layer 22 and the third sheet layer 23 can be separated, is formed along the concave folded line portion 19 of the folded portion 20.

Figure 6:
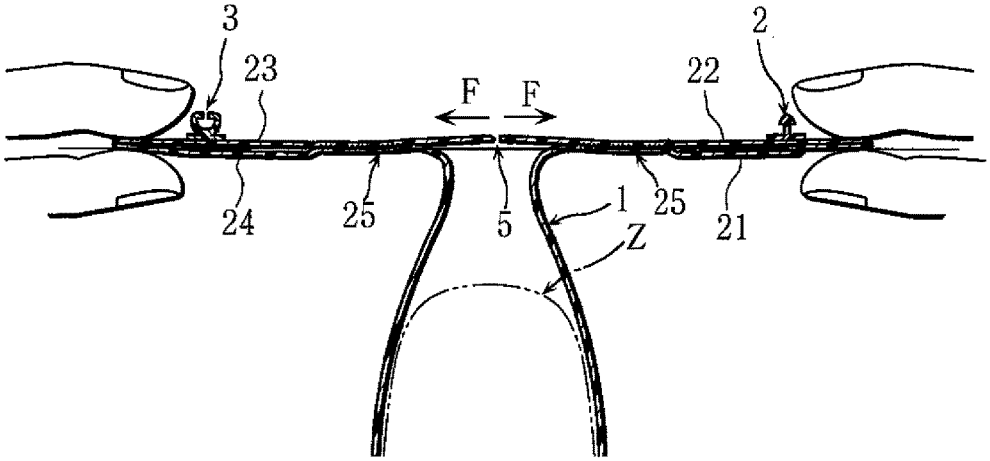
FIG. 6 is a cross-sectional view in which a separation-prepared line portion is just separated.

The separation-prepared line portion 5 is composed of half-cut laser-worked grooves 7 disposed parallel with a small interval $W_0$ and concaved on an inner face 1*a* and an outer face 1*b* of the sheet material 1 as to be separated by giving a predetermined tensile force F by human hands (refer to FIG. 6).

The small interval $W_0$ of the half-cut laser-worked grooves 7 is set to be $0.1\ T \leq W_0 \leq 0.9\ T$ when a thickness dimension of the sheet material is T.

When the small interval $W_0$ is less than 0.1 T, the laser-worked grooves 7 are mutually connected and the sheet material 1 may be unintentionally broken. And, when the small interval $W_0$ is more than 0.9 T, each of the laser-worked grooves 7 independently cracks, and the tensile force for separation becomes unstable.

In the folded portion 20, a welded portion 25 of thin belt shape in left-and-right direction is formed by welding the first sheet layer 21 and the second sheet layer 22 near the concave folded line portion 19. And, a welded portion 25 of thin belt shape in left-and-right direction is formed by welding the third sheet layer 23 and the fourth sheet layer 24 near the concave folded line portion 19. The welded portion 25 is formed near the concave folded line portion 19 as to make a distance between a lower end edge of the welded portion 25 and the concave folded line portion 19 smaller than the width of the welded portion 25.

In the folded portion 20, fastener 4, which can tightly seal the second sheet layer 22 and the third sheet layer 23 mutually, is provided, and the separation-prepared line portion 5 is disposed on an inner side of the bag against the fastener 4.

The fastener 4 is composed of a chuck tape male portion 2 having a convex portion and a chuck tape female portion 3 having a concave portion to which the convex portion fits, and the chuck tape male portion 2 and the chuck tape female portion 3 are welded to inner face near the convex folded line portions 18 of the second sheet layer 22 and the third sheet layer 23 as to make the convex portion and the concave portion facing. With the fastener 4, the fitting of the convex portion and the concave portion is released by holding and pulling near the convex folded line portion 18 of the first sheet layer 21 and the second sheet layer 22 and near the convex folded line portion 18 of the third sheet layer 23 and the fourth sheet layer 24 by fingers to open the fastener 4 (refer to FIG. 6). The convex portion and the concave portion can be fit by holding the outer face of the folded portion 20 by fingers to mutually press the chuck tape male portion 2 and the chuck tape female portion 3 to close the fastener 4.

A method of use (function) of the above-described packing bag of the present invention is described.

As shown in FIG. 1, the packing bag of the present invention stores the stored article Z with tight seal to keep the stored article Z against humidity or prevent the stored article Z from being dried to be protected with sanitation.

Figure 4:
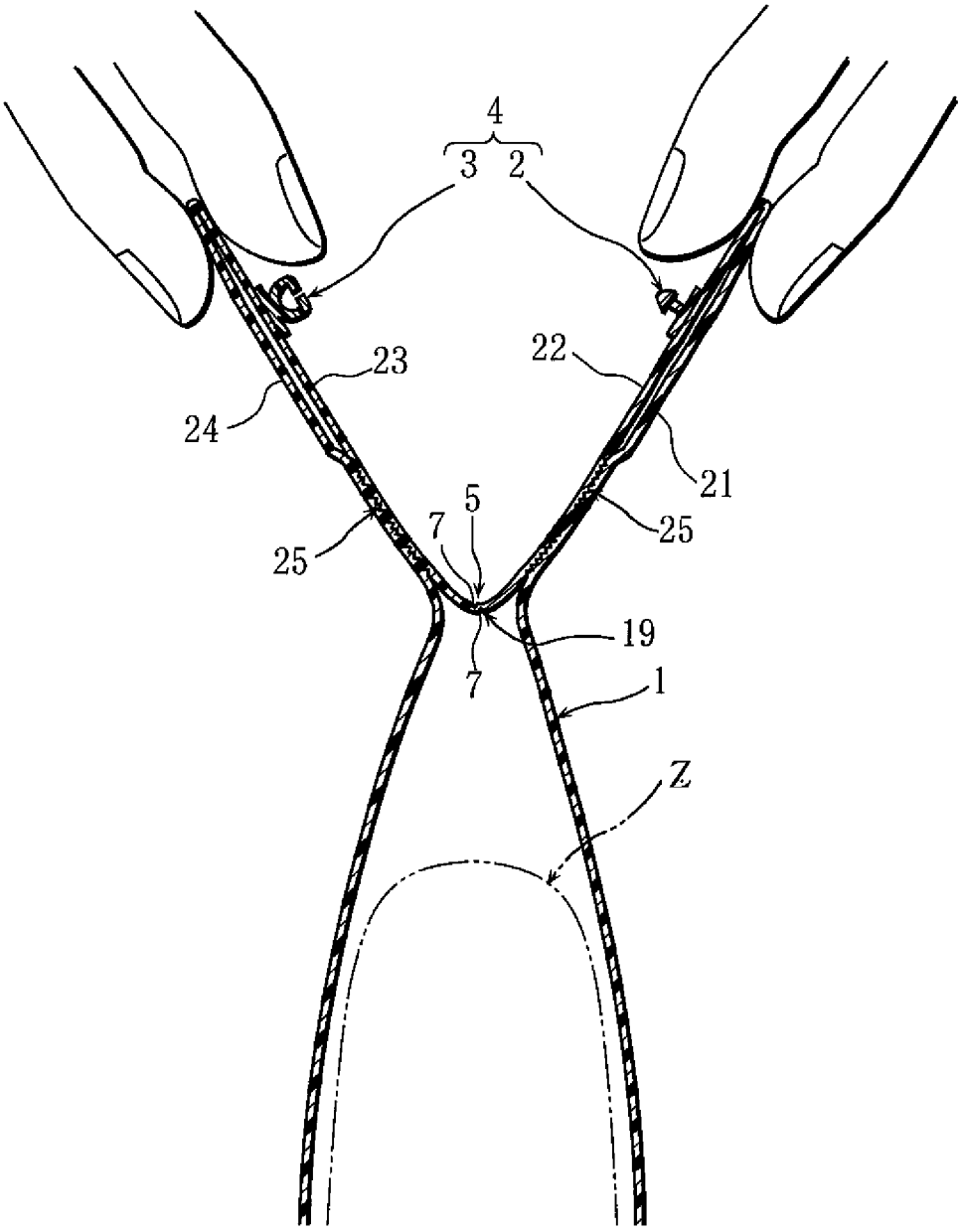
FIG. 4 is a cross-sectional view showing a used state.
Figure 5:
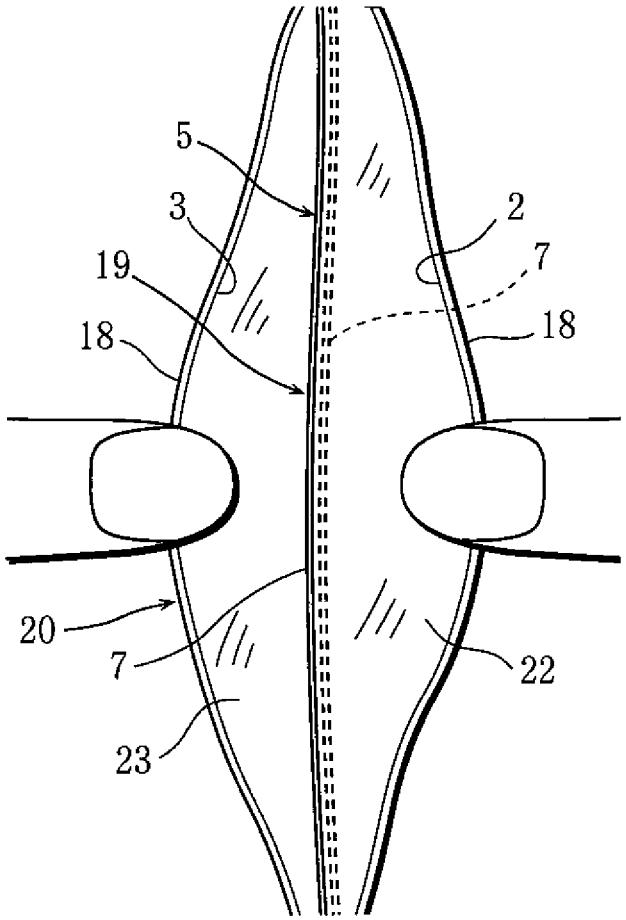
FIG. 5 is a top view showing the used state.

Next, as shown in FIG. 4 and FIG. 5, the fastener 4 is opened by opening the folded portion 20. At this moment, the separation-prepared line portion 5 is still not separated, and the bag is kept tightly sealed.

Figure 7:
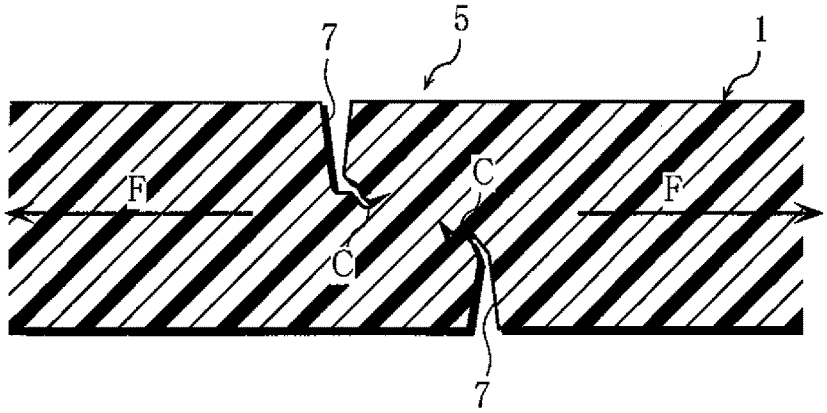
FIG. 7 is an enlarged cross-sectional view of a principal portion just before the separation of the separation-prepared line portion.
Figure 8:
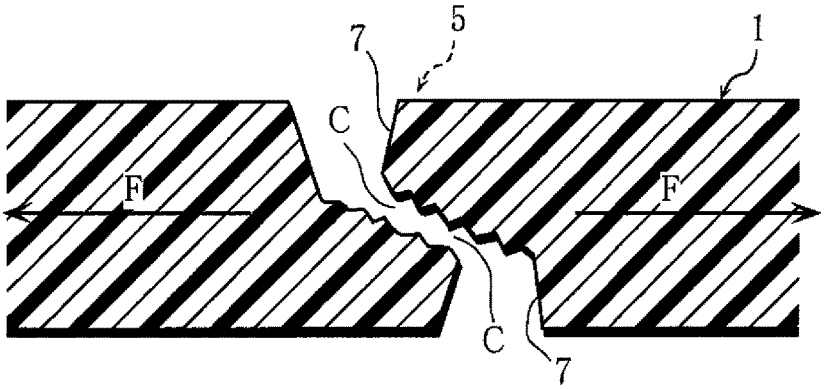
FIG. 8 is an enlarged cross-sectional view of the principal portion just after the separation of the separation-prepared line portion.

In FIG. 6, the folded portion 20 is opened further, the predetermined tensile force F (by human hands) is given to the separation-prepared line portion 5, and the second sheet layer 22 and the third sheet layer 23 are separated along the separation-prepared line portion 5. That is to say, the packing bag is opened, and the stored article Z can be taken out. In this case, as shown in FIG. 7 and FIG. 8, cracks C of the sheet material are generated between the laser-worked grooves 7 on the separation-prepared line portion 5, and the separation-prepared line portion 5 is separated when the cracks C are mutually connected.

The tensile force F given by the human hands is easily transmitted to the separation-prepared line portion 5, and the separation-prepared line portion 5 can be smoothly separated because the first sheet layer 21 and the second sheet layer 22 are welded on the welded portion 25, and the third sheet layer 23 and the fourth sheet layer 24 are welded on the welded portion 25. And, the stored article Z can be prevented from intruding between the first sheet layer 21 and the second sheet layer 22 and between the third sheet layer 23 and the fourth sheet layer 24 when taken out, and the stored article Z does not hitch to the second sheet layer 22 and the third sheet layer 23 and does not make the takeout difficult. Once opened, quasi-tight sealed state can be made by closing the fastener 4.

Next, a manufacturing method of the packing bag of the present invention is described.

Figure 9:
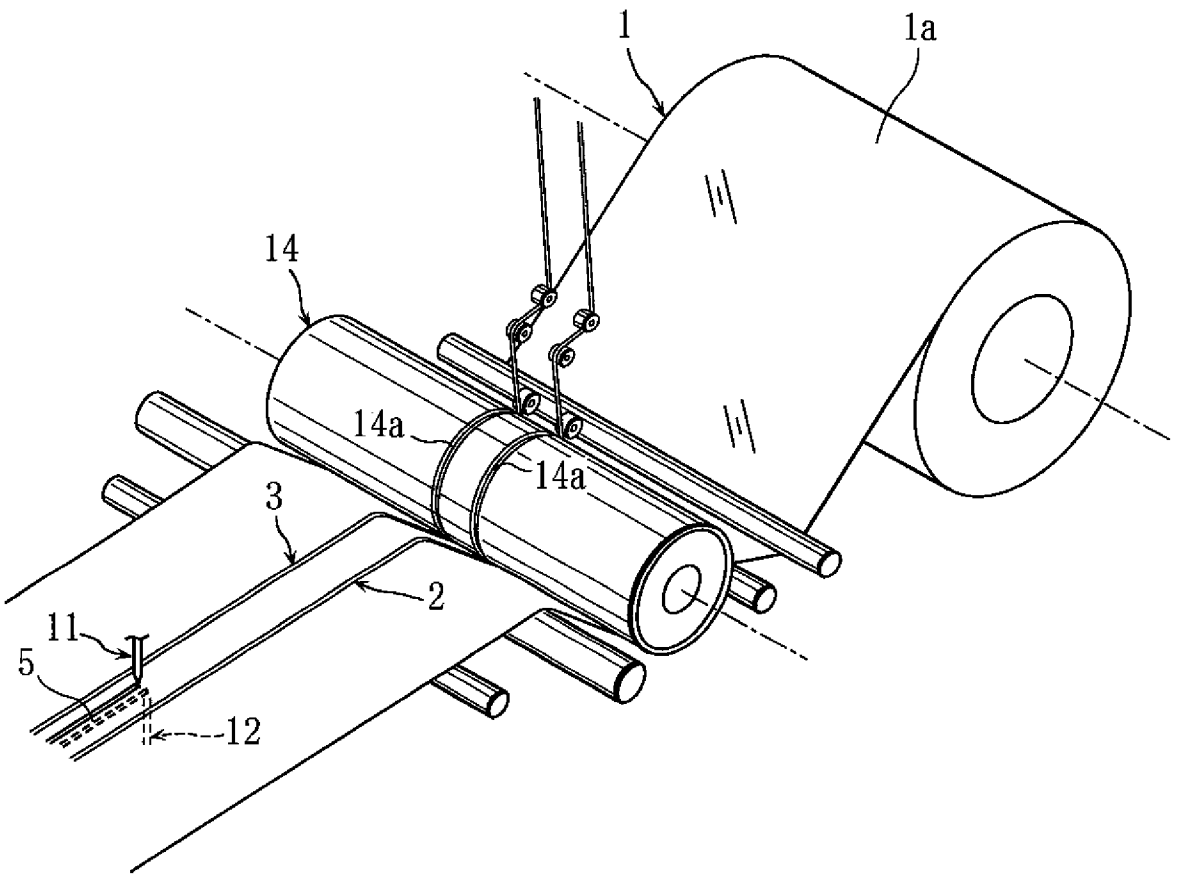
FIG. 9 is a perspective view showing a manufacturing method of the packing bag.

As shown in FIG. 9, the sheet material 1 of belt is continuously run, and, the chuck tape male portion 2 and the chuck tape female portion 3 are disposed parallel on a face 1*a* of the sheet material 1 along a longitudinal direction to weld. In this chuck tape welding process, the long chuck tape male portion 2 and the chuck tape female portion 3 being continuously sent, are inserted to concave peripheral grooves 14*a* disposed on a drum 14, and the chuck tape male portion 2 and the chuck tape female portion 3 are welded to the face 1*a* of the sheet material 1 by giving heat and pressure.

In a preliminary process of the chuck tape welding process, letters, figures, signs, patterns, colors, etc. are printed on the face 1*a* of the sheet material 1.

Figure 10:
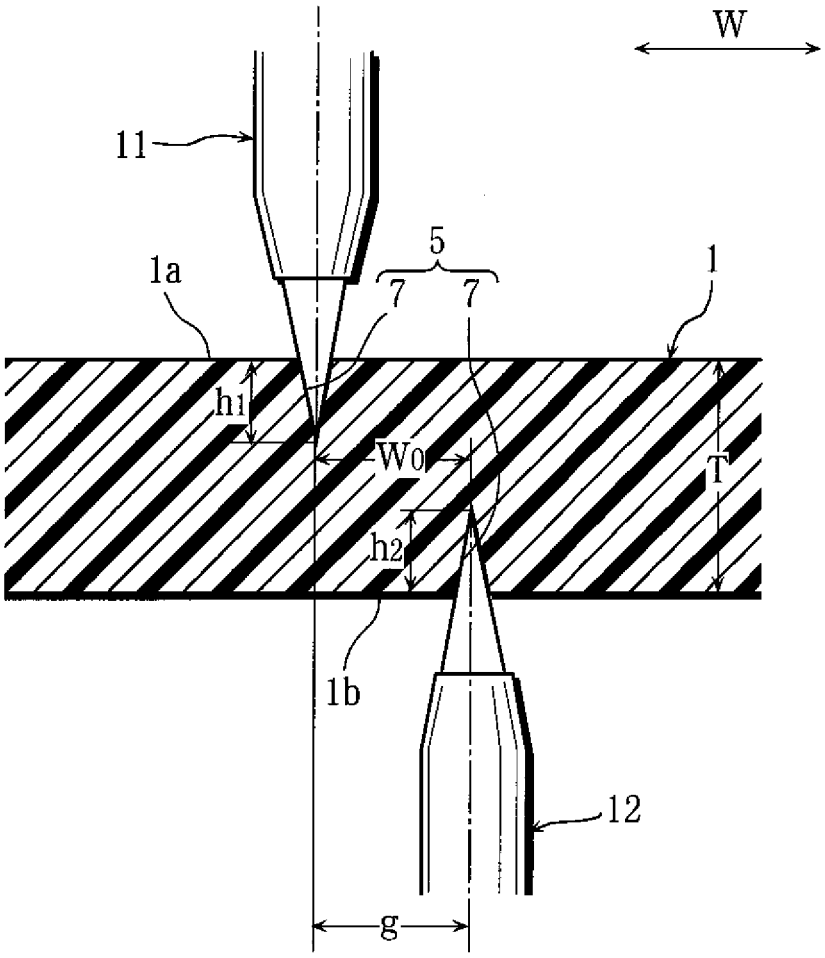
FIG. 10 is an enlarged cross-sectional view of a principal portion.

Next, as shown in FIG. 9 and FIG. 10, a first laser irradiating portion 11 and a second laser irradiating portion 12 are disposed on the face 1*a* and the other face 1*b* sides with a predetermined small gap g in a width direction W of the sheet to form the laser-worked grooves 7 with the small interval $W_0$ on the face 1*a* and the other face 1*b* of the belt-shaped sheet material 1 continuously running. This process is called laser irradiation process. The above-described separation-prepared line portion 5 of the packing bag is formed with the half-cut laser-worked grooves 7 formed by the laser irradiation process. Depth dimensions $h_1$ and $h_2$ of the laser-worked grooves 7 are preferably set to be 20 to 45% of the thickness dimension T of the sheet material 1. When the depth dimensions $h_1$ and $h_2$ are less than 20%, the tensile force F, necessary for the separation of the separation-prepared line portion 5, becomes excessive, and, when the depth dimensions $h_1$ and $h_2$ are more than 45%, laser may penetrate the sheet material 1, and it is not preferable that the separation-prepared line portion 5 may unintentionally break.

Figure 21:
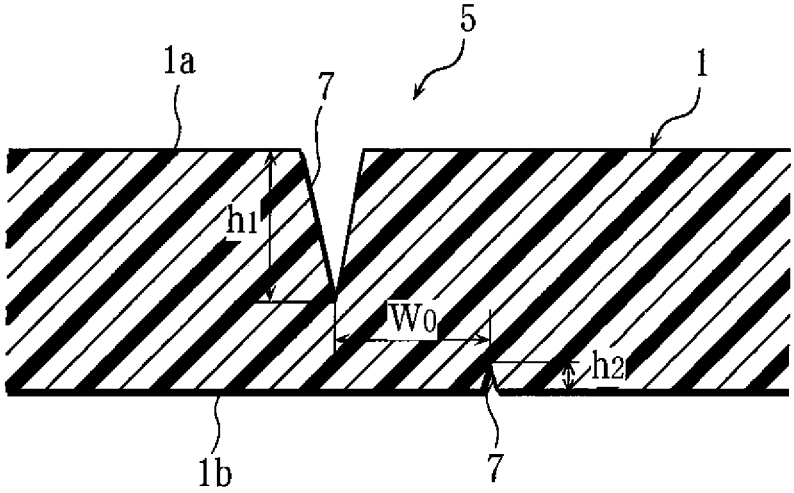
FIG. 21 is an enlarged cross-sectional view of a principal portion.
Figure 22:
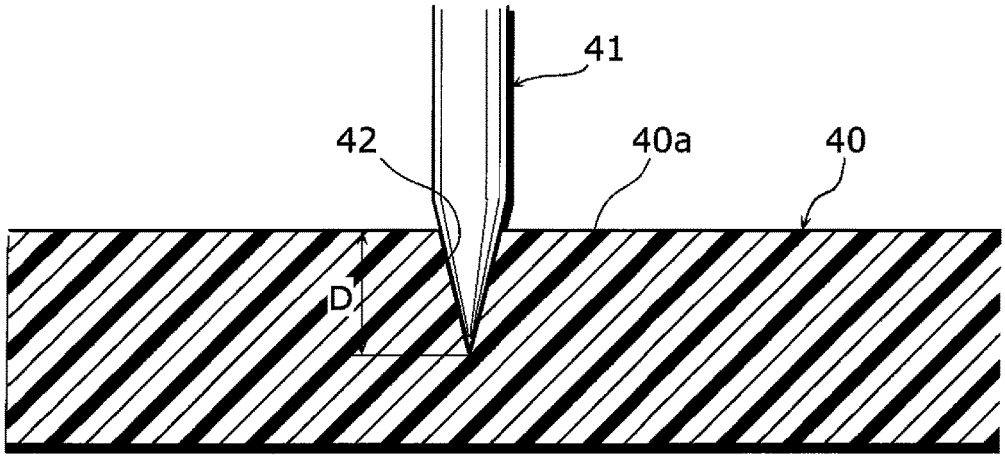
Fig. 22 PRIOR ART
FIG. 22 is an enlarged cross-sectional view of a principal portion showing a manufacturing method of a conventional packing bag.
Figure 23:
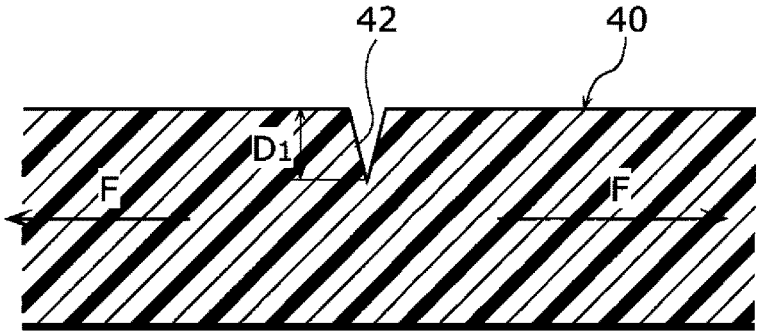
Fig. 23 PRIOR ART
FIG. 23 is an enlarged cross-sectional view of a principal portion showing the conventional packing bag.
Figure 24:
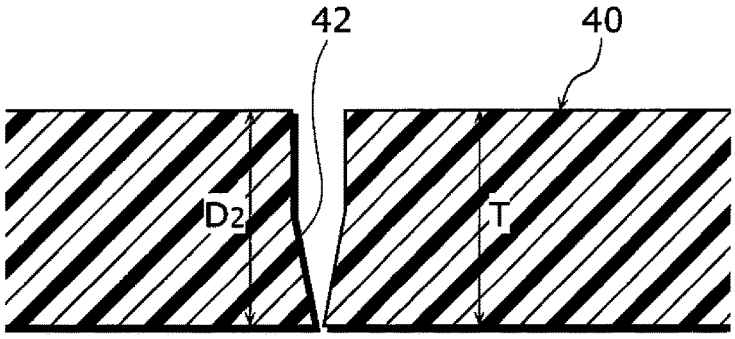
Fig. 24 PRIOR ART
FIG. 24 is an enlarged cross-sectional view of a principal portion showing the conventional packing bag.

In the laser irradiation process, although the continuously running belt-shaped sheet material 1 may oscillate up and down, the mutual distance of the laser-worked grooves 7 is kept constant as long as the small interval $W_0$ is constant because the depth dimension $h_2$ of the laser-worked groove 7 formed on the other face 1*b* is increased when the depth dimension $h_1$ of the laser-worked groove 7 formed on the face 1*a* of the sheet material 1 is decreased. And, as shown in FIG. 21, in case that the depth dimension $h_1$ of the laser-worked groove 7 formed on the face 1*a* of the sheet material 1 becomes excessive, the mutual distance of the laser-worked grooves 7 is kept constant as long as the depth dimension $h_2$ of the laser-worked groove 7 formed on the other face 1*b* is decreased and the small interval $W_0$ is constant. The first laser irradiating portion 11 and the second laser irradiating portion 12 can be positioned with high accuracy, the small interval $W_0$ is easily controlled to be constant, and the separation-prepared line portion 5 can be separated by giving the constant tensile force F.

Figure 11:
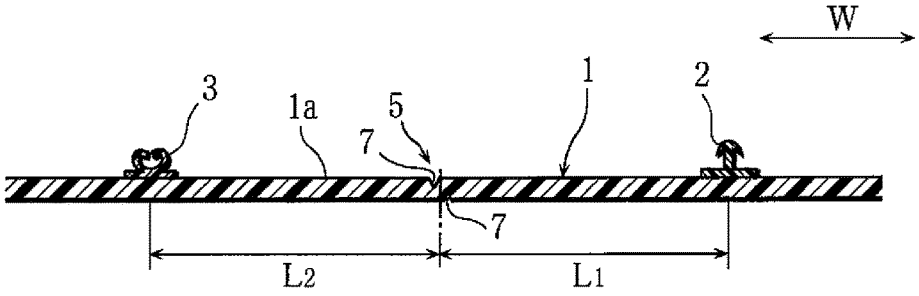
FIG. 11 is an enlarged cross-sectional view.

As shown in FIG. 11, the separation-prepared line portion 5 is formed along a center line in the sheet width direction W between the chuck tape male portion 2 and the chuck tape female portion 3. That is to say, a length dimension $L_1$ from the separation-prepared line portion 5 to the chuck tape male portion 2 and a length dimension $L_2$ from the separation-prepared line portion 5 to the chuck tape female portion 3 are set to be the same length.

Figure 12:
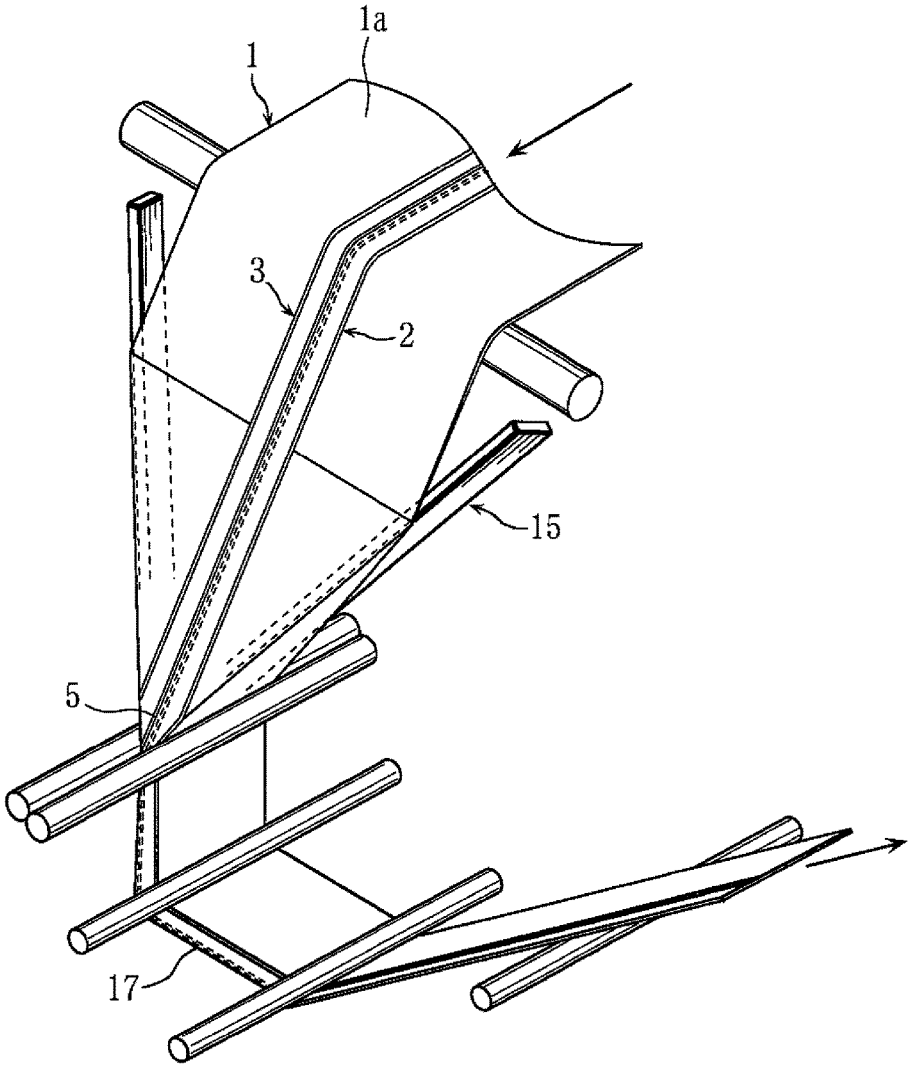
FIG. 12 is a perspective view showing the manufacturing method of the packing bag.
Figure 13:
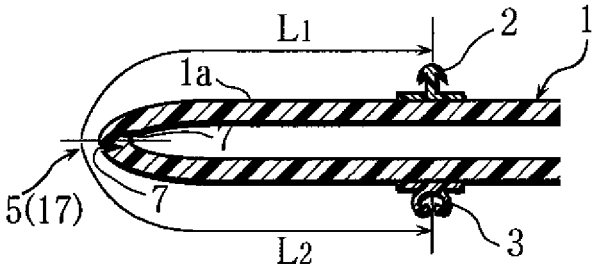
FIG. 13 is an enlarged cross-sectional view.

Then, as shown in FIG. 12, the sheet material 1 is folded along the separation-prepared line portion 5 as the face 1*a* is directed outward to form a fold back portion 17. In FIG. 12, the sheet material 1 is continuously run and made sliding on a triangular guiding plate 15, and the sheet material 1 is folded back as shown in FIG. 13. The separation-prepared line portion 5 is disposed along the fold back portion 17 and the convex portion of the chuck tape male portion 2 and the concave portion of the chuck tape female portion 3 are directed to mutually opposite directions on the positions of the length dimension $L_1$ and the length dimension $L_2$ the same length from the separation-prepared line portion 5.

Figure 14:
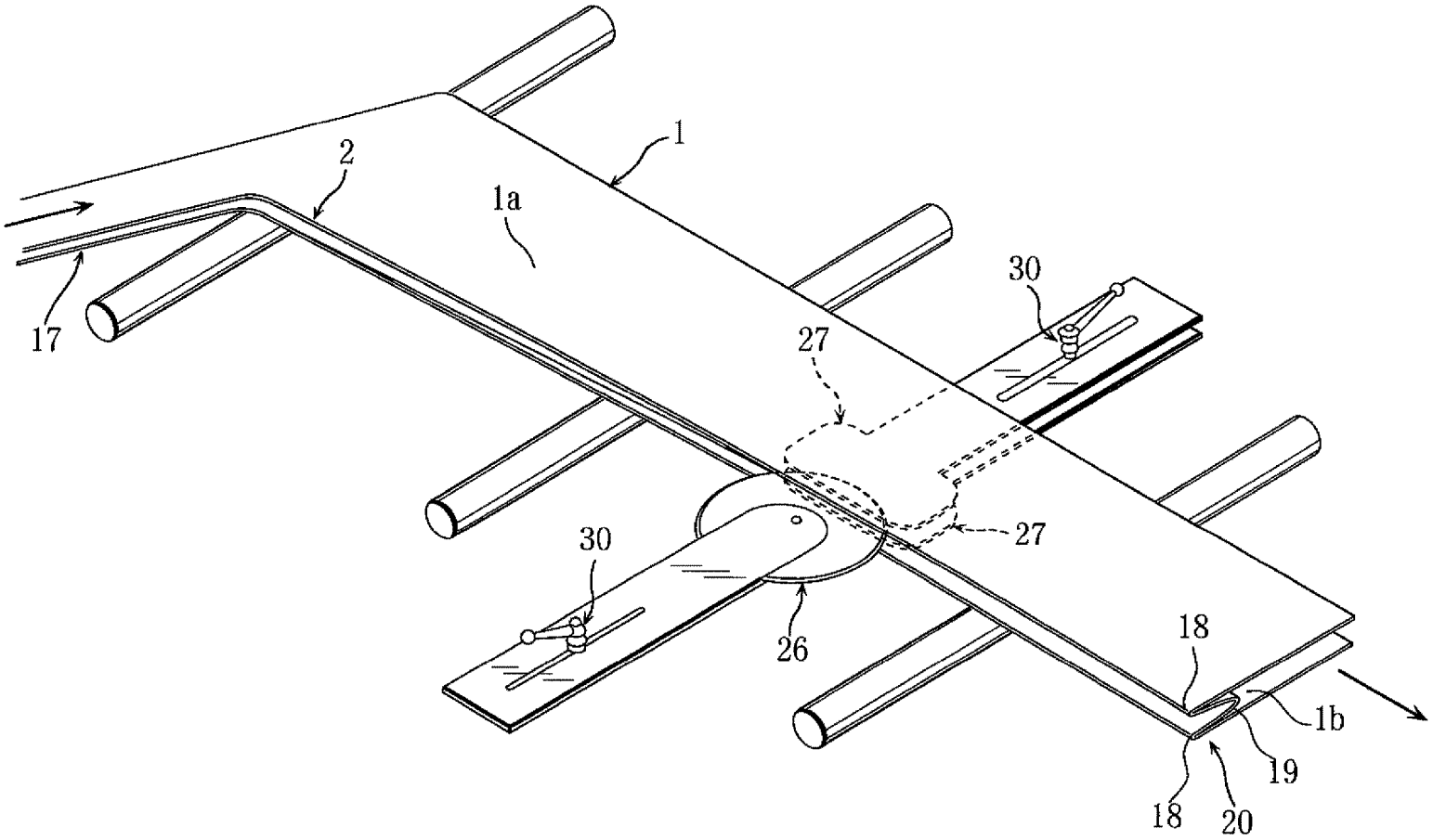
FIG. 14 is a perspective view showing the manufacturing method of the packing bag.

Next, as shown in FIG. 14, a guiding roller 26 for push-in is applied from outside (the face 1*a*) of the fold back portion 17 of the sheet material 1, a pair of guiding members 27, to which the guiding roller 26 is inserted, is applied from the inner side (the other face 1*b*) of the sheet material 1, and the sheet material 1 is folded along the two convex folded line portions 18 and the concave folded line portion 19 to form the folded portion 20 of which cross section is M-shaped. In this case, the separation-prepared line portion 5 formed on a middle position between the chuck tape male portion 2 and the chuck tape female portion 3 is disposed to accurately correspond to the concave folded line portion 19. The depth dimension from the convex folded line portions 18 to the concave folded line portion 19 of the folded portion 20 can be freely changed by an adjustment means 30 to adjust the insertion depth of the guiding roller 26 and the reverse-folding guiding members 27.

Figure 15:
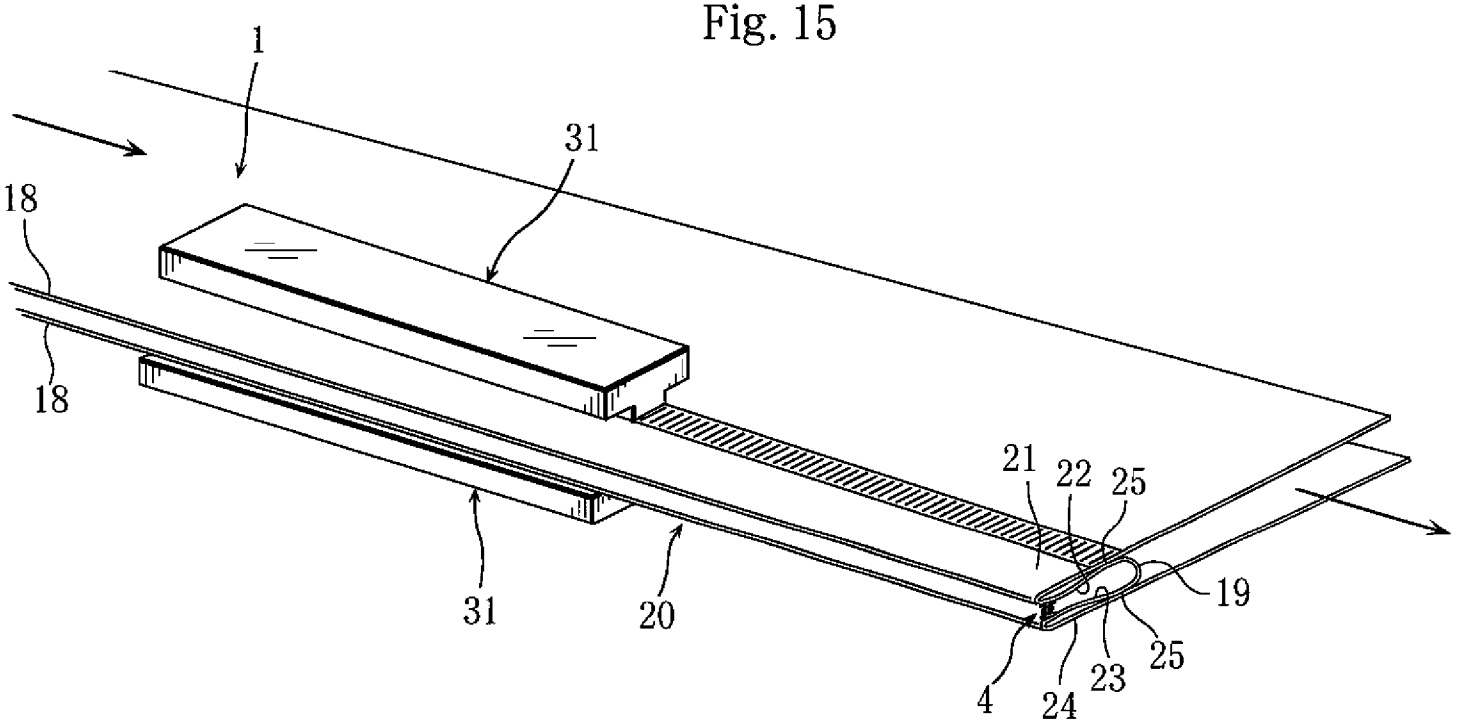
FIG. 15 is a perspective view showing the manufacturing method of the packing bag.

The sheet material 1 in continuous running is switched to intermittent feeding by a feeding speed regulating device (not shown in figures), and, as shown in FIG. 15, the first sheet layer 21 and the second sheet layer 22 are mutually welded, and the third sheet layer 23 and the fourth sheet layer 24 are mutually welded by welded portion forming means 31 pressed to the folded portion 20 on upper and lower sides.

Figure 16:
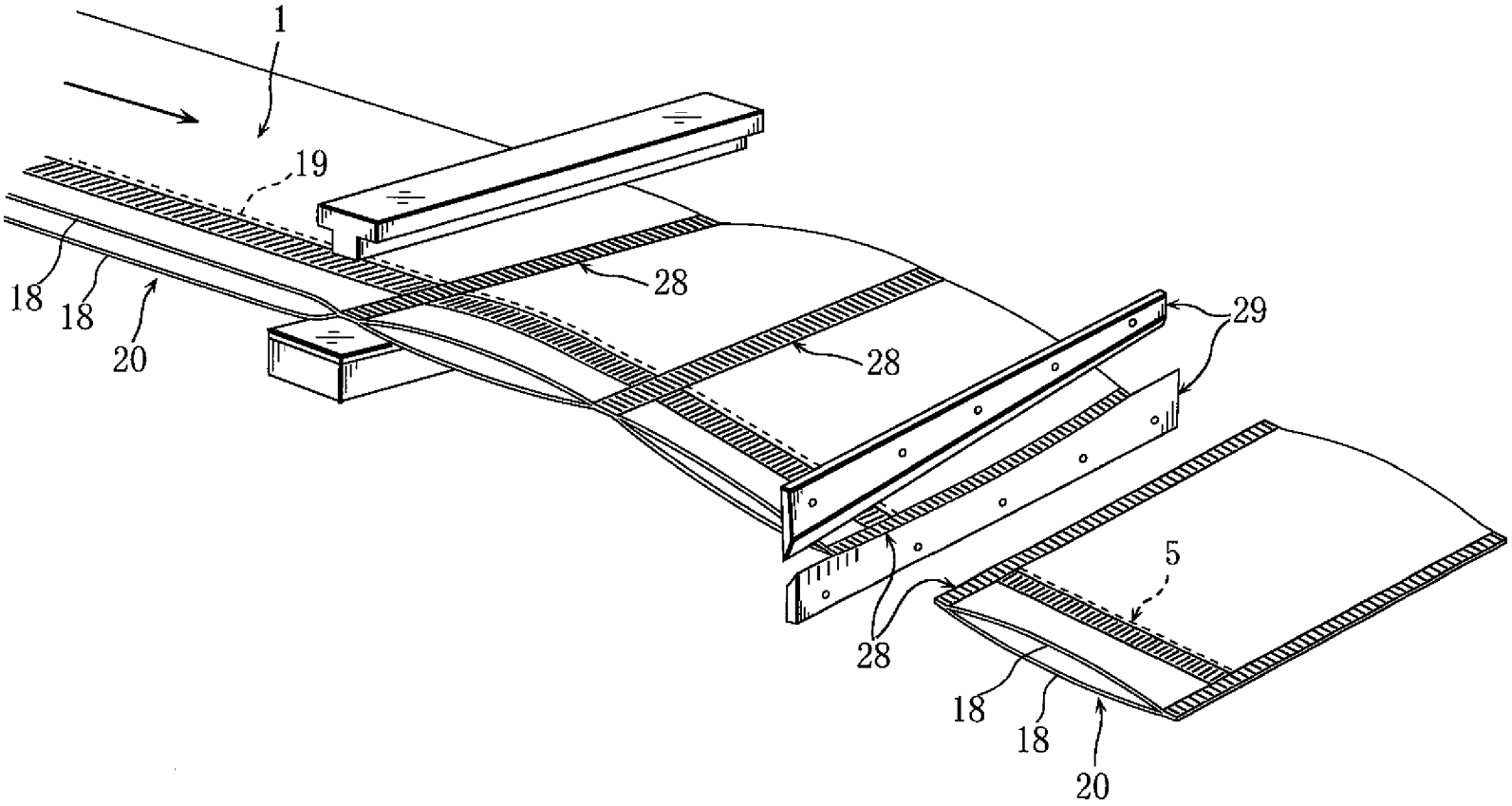
FIG. 16 is a perspective view showing the manufacturing method of the packing bag.

Next, as shown in FIG. 16, welded portions 28 in width direction are serially formed with predetermined pitch for the entire length in width direction of the sheet material 1, and the sheet material 1 is cut on a center position of the welded portion 28 in width direction by a cutting means 29. And, the sheet material 1 may be cut by "weld cutting" in which the cutting is conducted simultaneously with the forming of the welded portion 28.

Figure 17:
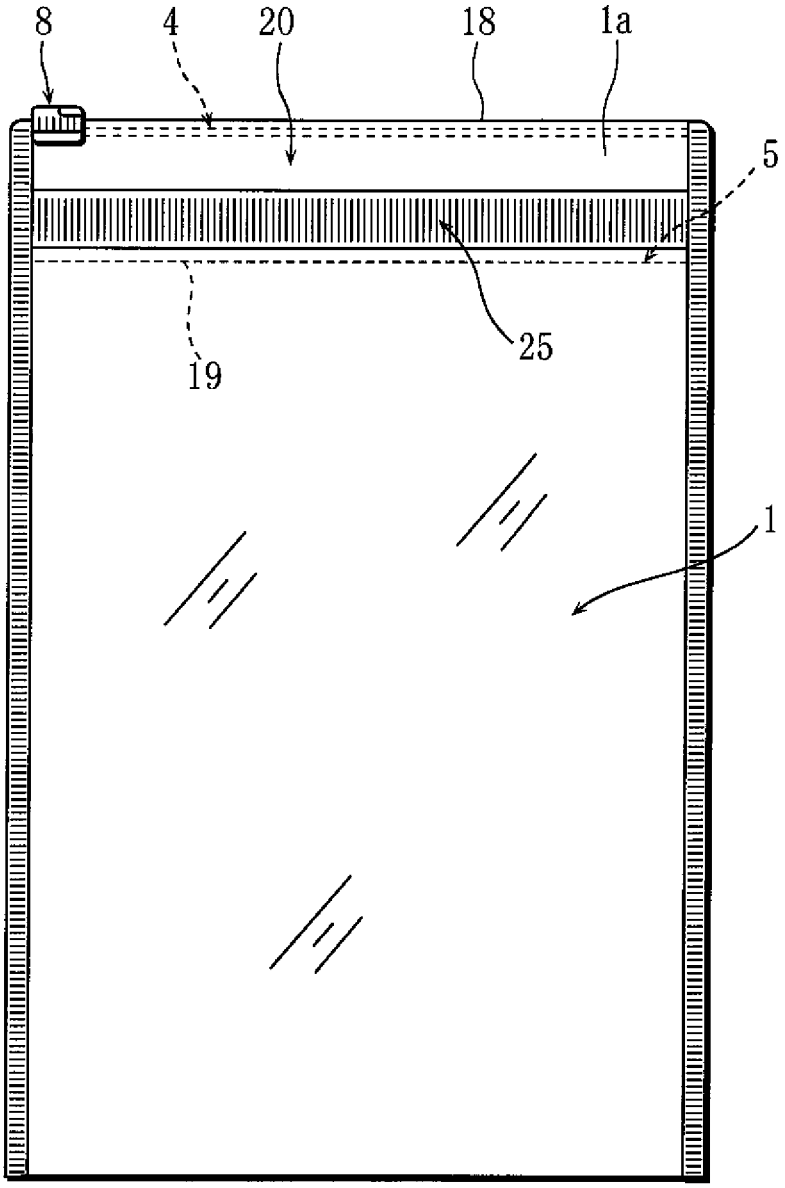
FIG. 17 is a front view showing another embodiment of the present invention.

In FIG. 17, another embodiment of the present invention is shown.

The packing bag of the present invention may be provided with a slider 8 to open and close the fastener 4.

The slider 8 has a construction in which two plastic parts are combined to be attached to the folded portion 20. One of the parts composing the slider 8 plays a role of opening the fastener 4, and the other plays a role of closing the fastener 4.

Figure 18:
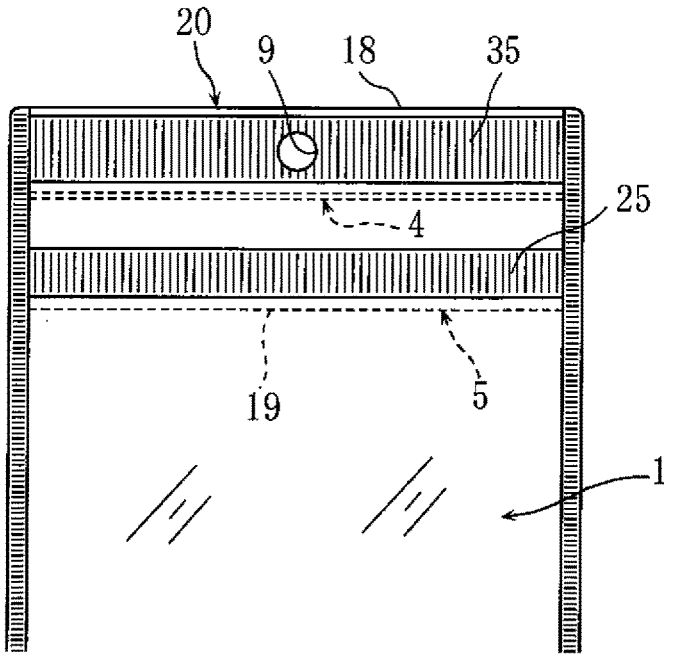
FIG. 18 is a front view showing still another embodiment of the present invention.

As shown in FIG. 18, the packing bag of the present invention may be provided with a through hole 9 for suspension.

The folded portion 20 keeps sufficient strength for the layering of the first sheet layer 21, the second sheet layer 22, the third sheet layer 23, and the fourth sheet layer 24, the folded portion 20 can support a load without deformation when suspended by a hook inserted to the through hole 9, and the bag is appropriate for suspended display. And, a belt-shaped welded portion 35 may be formed near the convex folded line portions 18 of the folded portion 20. The strength of the folded portion 20 is improved further to certainly support the load of the packing bag.

Figure 19:
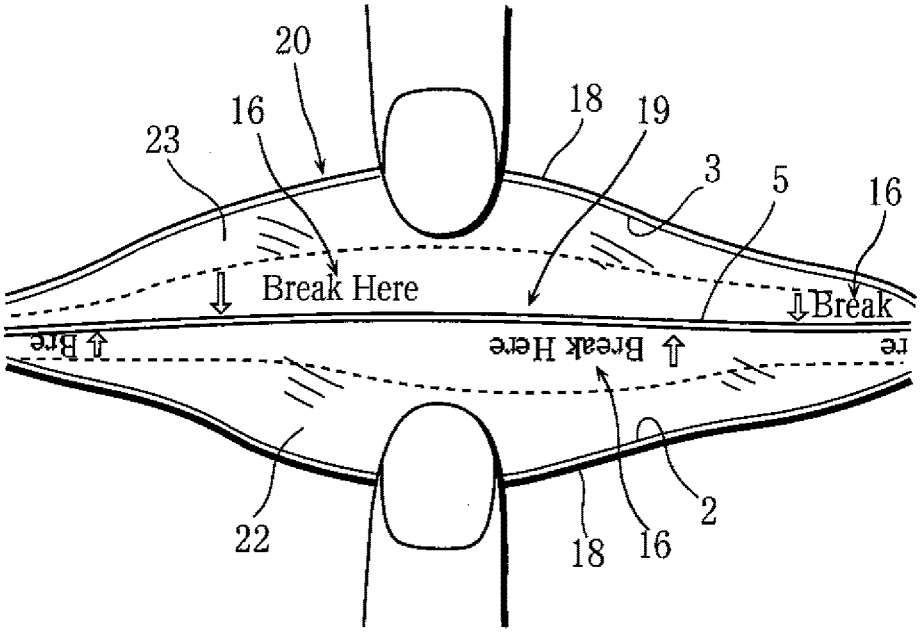
FIG. 19 is a front view showing a further embodiment of the present invention.
Figure 20:
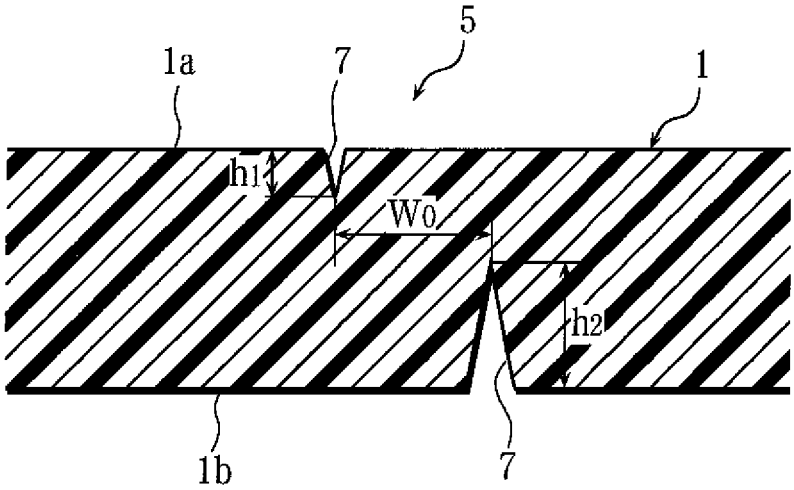
FIG. 20 is an enlarged cross-sectional view of a principal portion.

As shown in FIG. 19, the packing bag of the present invention may be provided with an indicating portion 16 to instruct breaking on a belt-shaped area near the separation-prepared line portion 5.

The indicating portion 16, concretely, is composed of an arrow indicating the separation-prepared line portion 5 and a phrase "Break here!". The indicating portion 16, not restricted to the example, the letters and the sign may be changed, and other letters, figures, signs, patterns, and colors may be added. The belt-shaped area near the separation-prepared line portion 5 is a part of or entire belt-shaped area between the chuck tape male portion 2 and the chuck tape female portion 3 of the face 1*a* of the sheet material 1, and, in other words, a part of or entire inner faces of the second sheet layer 22 and the third sheet layer 23 of the folded portion 20. When the sheet material 1 in rolled state is preliminarily printed with letters and signs on the face 1*a*, the indicating portion 16 can be disposed on the inner side of the folded portion 20 (the inner faces of the second sheet layer 22 and the third sheet layer 23) by folding the sheet material 1, and the indicating portion 16 can be easily provided with low cost.

In the present invention, being modifiable, the welded portions 25, for example, may be omitted. And, although not shown in figures, two packing bags may be may be made of one sheet material 1.

As described above, unintentional break of the separation-prepared line portion 5 can be certainly prevented to keep the tight seal because the packing bag of the present invention is a packing bag to store the stored article Z with tight seal by the welded sheet material 1 in which the separation-prepared line portion 5, separable by the predetermined tensile force F by human hands, is provided, and the separation-prepared line portion 5 is composed of the half-cut laser-worked grooves 7 disposed parallel with the small interval $W_0$ and concaved on the inner face 1*a* and the outer face 1*b*. And, the separation-prepared line portion 5 can be separated by the constant tensile force F when a user intentionally breaks by hands. The tensile force F necessary for the separation of the separation-prepared line portion 5 can be freely controlled.

And, unintentional break of the separation-prepared line portion 5 can be certainly prevented and the separation-prepared line portion 5 can be separated by the constant tensile force F because the small interval $W_0$ is set to be $0.1\ T \leq W_0 \leq 0.9\ T$ relating to the thickness dimension T of the sheet material 1.

And, according to the manufacturing method of packing bag of the present invention, the half-cut laser-worked grooves 7 can be accurately formed on the face 1*a* and the face 1*b* of the sheet material 1 continuously running, and unintentional break of the separation-prepared line portion 5 can be certainly prevented to keep the tight seal because the laser irradiating process, in which the first laser irradiating portion 11 and the second laser irradiating portion 12 are disposed on the face 1*a* and the other face 1*b* of the belt-shaped sheet material 1 with the predetermined small gap g in the sheet width direction W, the two half-cut laser-worked grooves 7 are formed parallel with the small interval $W_0$ on the face 1*a* and the other face 1*b* of the belt-shaped sheet material 1 continuously running, and the separation-prepared line portion 5 is composed of the half-cut laser-worked grooves 7, is provided. The separation-prepared line portion 5, separable by the constant tensile force F, can be formed certainly and beautifully with high quality. The small interval $W_0$ between the half-cut laser-worked grooves 7 can be freely set, and the tensile force F necessary for the separation of the separation-prepared line portion 5 can be freely controlled.

While preferred embodiments of the present invention have been described in this specification, it is to be understood that the invention is illustrative and not restrictive, because various changes are possible within the spirit and indispensable features.

What is claimed is:

1. A packing bag to store a stored article with tight seal, comprising a welded sheet material, wherein the welded sheet material is folded on two convex folded line portion and a concave folded line portion to form a folded portion M-shaped in longitudinal cross-section, wherein the welded sheet material includes a separation-prepared line portion, which is separable by predetermined tensile force by human hands, wherein the separation-prepared line portion is composed of half-cut laser-worked grooves disposed in parallel with a small interval therebetween along a longitudinal direction in which the welded sheet material extends, wherein the separation-prepared line portion is concaved on an inner face and an outer face of the welded sheet material, and wherein a mutual distance of the laser-worked grooves is kept constant when the small interval is kept constant and when a depth dimension of one of the laser-worked grooves is increased while a depth dimension of another one of the laser-worked grooves is decreased.

2. The packing bag as set forth in claim 1, wherein the small interval is set to be 0.1 to 0.9 of a thickness dimension of the sheet material.

3. The packing bag as set forth in claim 1, wherein the separation-prepared line portion is composed of the half-cut laser-worked grooves disposed in parallel with the small interval therebetween along a direction in which the predetermined tensile force is to be applied.

* * * * *